US005595157A

United States Patent [19]

Siew et al.

[11] Patent Number: 5,595,157

[45] Date of Patent: Jan. 21, 1997

[54] AIR GUIDING DEVICE

[76] Inventors: Seok H. Siew, 39 Jalan Timah 7, Taman Sri Puteri, Johor 81300 Skudai, Malaysia; Roger C. T. Chen, Block #12, #04-218 Teck Whye Lane, Singapore 2368, Singapore

[21] Appl. No.: 505,176

[22] PCT Filed: Feb. 8, 1994

[86] PCT No.: PCT/GB94/00236

§ 371 Date: Aug. 11, 1995

§ 102(e) Date: Aug. 11, 1995

[87] PCT Pub. No.: WO94/18448

PCT Pub. Date: Aug. 18, 1994

[30] Foreign Application Priority Data

Feb. 13, 1993 [MY] Malaysia ..... UI9300243
Jul. 6, 1993 [GB] United Kingdom ..... 9313949

[51] Int. Cl.[6] ..... F02M 29/06; F02M 29/04

[52] U.S. Cl. ..... 123/306; 123/592

[58] Field of Search ..... 123/306, 590, 123/592

[56] References Cited

U.S. PATENT DOCUMENTS

| | | | |
|---|---|---|---|
| 1,969,202 | 8/1934 | Bugaud | 123/306 |
| 4,116,187 | 9/1978 | Moore | 123/592 |
| 4,345,574 | 8/1982 | Iwami | 123/587 |
| 4,417,562 | 11/1983 | Dalke | 123/592 |
| 4,671,247 | 6/1987 | Barbee | 123/592 |
| 4,729,776 | 3/1988 | Elliff | 55/455 |
| 5,113,838 | 5/1992 | Kim | 123/592 |
| 5,137,005 | 8/1992 | Kirby | 123/592 |

FOREIGN PATENT DOCUMENTS

| | | | |
|---|---|---|---|
| 337921 | 5/1904 | France . | |
| 697336 | 1/1931 | France . | |
| 2219982 | 11/1973 | Germany | 123/592 |
| 5813122 | 4/1983 | Japan . | |
| 0239817 | 9/1925 | United Kingdom . | |
| 0239762 | 9/1925 | United Kingdom . | |
| 0309362 | 4/1929 | United Kingdom . | |
| 0444020 | 3/1936 | United Kingdom . | |
| 1496040 | 12/1977 | United Kingdom . | |

*Primary Examiner*—Willis R. Wolfe
*Attorney, Agent, or Firm*—Stoel Rives LLP

[57] ABSTRACT

An air guiding device for producing a vortical and/or turbulent air flow in an inlet manifold, which device comprises a fixed supporting structure, a plurality of vanes carried by the supporting structure for deflecting an air flow impinging on the device in a first direction, a tab associated with at least one of the vanes for deflecting the air flow in a second direction, the arrangement being such that the air flow impinging on the device is deflected into a vortical and/or turbulent air flow by the vanes and/or tab or tabs.

20 Claims, 2 Drawing Sheets

AIR GUIDING DEVICE

This application is a 371 of PCT/GB94/00236, filed Feb. 8, 1994, which claims priority from Great Britain Application No. 9313949.1, filed Jul. 6, 1993, which is a continuation-in-part of Malaysian Application No. UI 9300243, filed Feb. 13, 1993.

The present invention relates to an air guiding device for use in combination with an internal combustion engine to create a vortical or turbulent air flow in the air entering a carburettor.

Combustion engines require a mixture of air and fuel to be delivered to the engine for combustion purposes. Air is delivered to the carburettor through an air filter and the filtered air is mixed with the fuel in the carburettor which supplies a fine stream of fuel droplets for mixing with a steady air stream which is drawn by the low pressure present in the carburettor during each induction stroke of each respective cylinder in an engine. However, because the air flow to and through the carburettor is generally laminar and non-vortical there is little opportunity for the fuel droplets to mix efficiently with the air to provide a homogeneous fuel-air mixture for optimum combustion characteristics.

At high air flow rates, is when a throttle of the engine is fully open, some turbulence may be caused naturally which aids the mixing process. However, at low air flow rates there is little mixing of fuel and air due to the low energy of the air flow.

It is an object of the present invention to improve the mixing process at low air flow rates.

Accordingly, one aspect of the present invention provides an air guiding device for producing a vortical and/or turbulent air flow in an inlet manifold, which device comprises a fixed supporting structure, a plurality of vanes carried by the supporting structure for deflecting an air flow impringing on the device in a first direction, a tab associated with at least one of the vanes for deflecting the air flow in a second direction, the arrangement being such that the air flow impinging on the device is deflected into a vortical and/or turbulent air flow by the vanes and/or the tab or tabs.

In order that the present invention may be more readily understood, embodiments thereof will now be described, by way of example, with reference to the accompanying drawings, in which.

Figure 1:
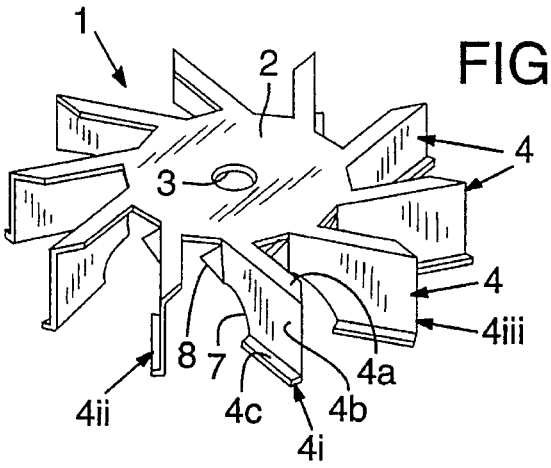
FIG. 1 is a perspective view of a first embodiment of an air guiding device according to the present invention.

Referring to FIG. 1, a first air guiding device embodying the invention comprises a planar central hub plate 2 formed with a circular hole 3 at its centre for receiving an air filter closure securing bolt. Vanes 4 extend outwardly and downwardly from the periphery of the hub plate 2 at equally spaced apart locations around the periphery. Each vane 4 comprises a spoke portion 4*a*, a blade portion 4*b* and a lip portion 4*c*. The spoke portion 4*a* is coplanar with the hub plate 2 and extends outwardly from the periphery of the hub plate 2 at an angle of approximately 45° to the radial direction as shown in FIG. 1. The blade portion 4*b* extends downwardly from one edge of the spoke portion 4*a* and lies substantially perpendicular to the plane of the hub plate 2 and terminates at its lower edge in the lip portion 4*c* which projects from the blade portion parallel to the spoke portion 4*a* on the other side of the blade portion from the spoke portion.

Figure 6:
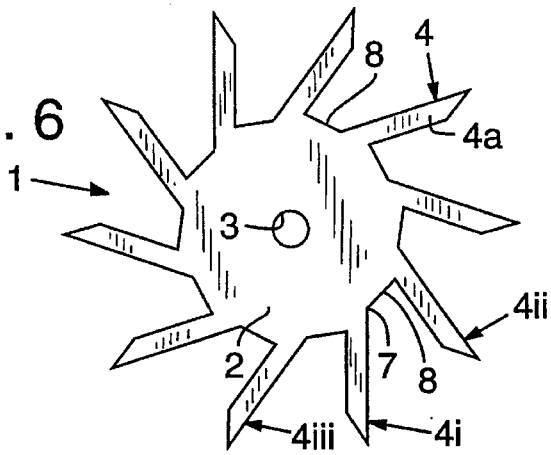
FIG. 6 shows a view from below of the air guiding device of FIG. 1 (a lip portion of each vane is not shown).

The blade portion 4*b* is cut away at its lower radially innermost corner, so that the radially innermost edge 7 of the blade portion is shorter than its radially outermost edge and the lower edge of the blade portion is shorter than its upper edge. The radially innermost edge 7 of the blade portion 4*b* of each vane 4*i* is provided with a tab or deflector 8 which lies substantially tangential to the plate hub 2 and substantially perpendicular to an adjacent leading vane 4*ii* and substantially parallel with an adjacent following vane 4*iii*. This arrangement is more clearly depicted in FIG. 6. In the embodiment shown in FIG. 1, the tab 8 is of a generally triangular shape, although this tab 8 may, of course, have any suitable shape as may the vanes 4. The air guiding device of FIG. 1 is shown with ten vanes 4 and tabs 8, but other embodiments can be formed with more, or fewer, vanes 4 and tabs 8.

In a preferred embodiment of the air guiding device, ten vanes 4 are each provided with a respective tab 8. The tabs 8 are each angled at approximately 135° to their respective vane 4.

The air guiding device 1 of FIG. 1 is cut and formed from a single thin metal sheet, although the device could be made in other ways, such as by moulding or casting the device or by assembling the device from a number of discrete components.

Figure 4:
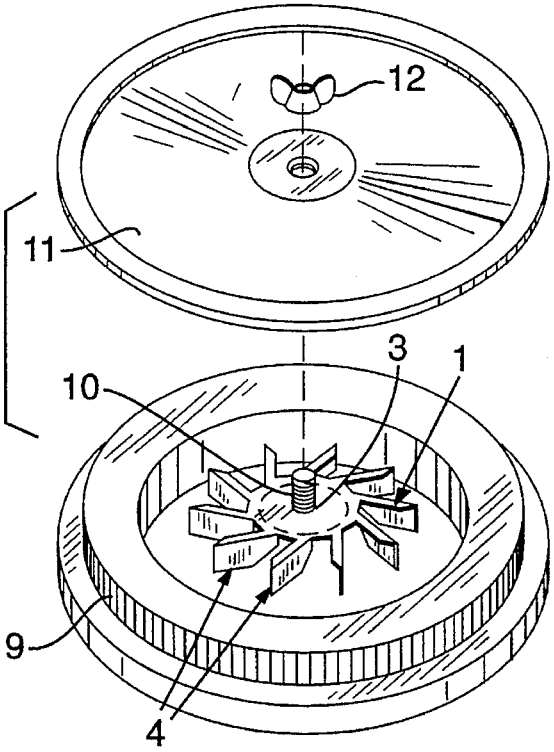
FIG. 4 is a perspective view showing the air guiding device of FIG. 2 installed within an annular filter element of an air filter.
Figure 2:
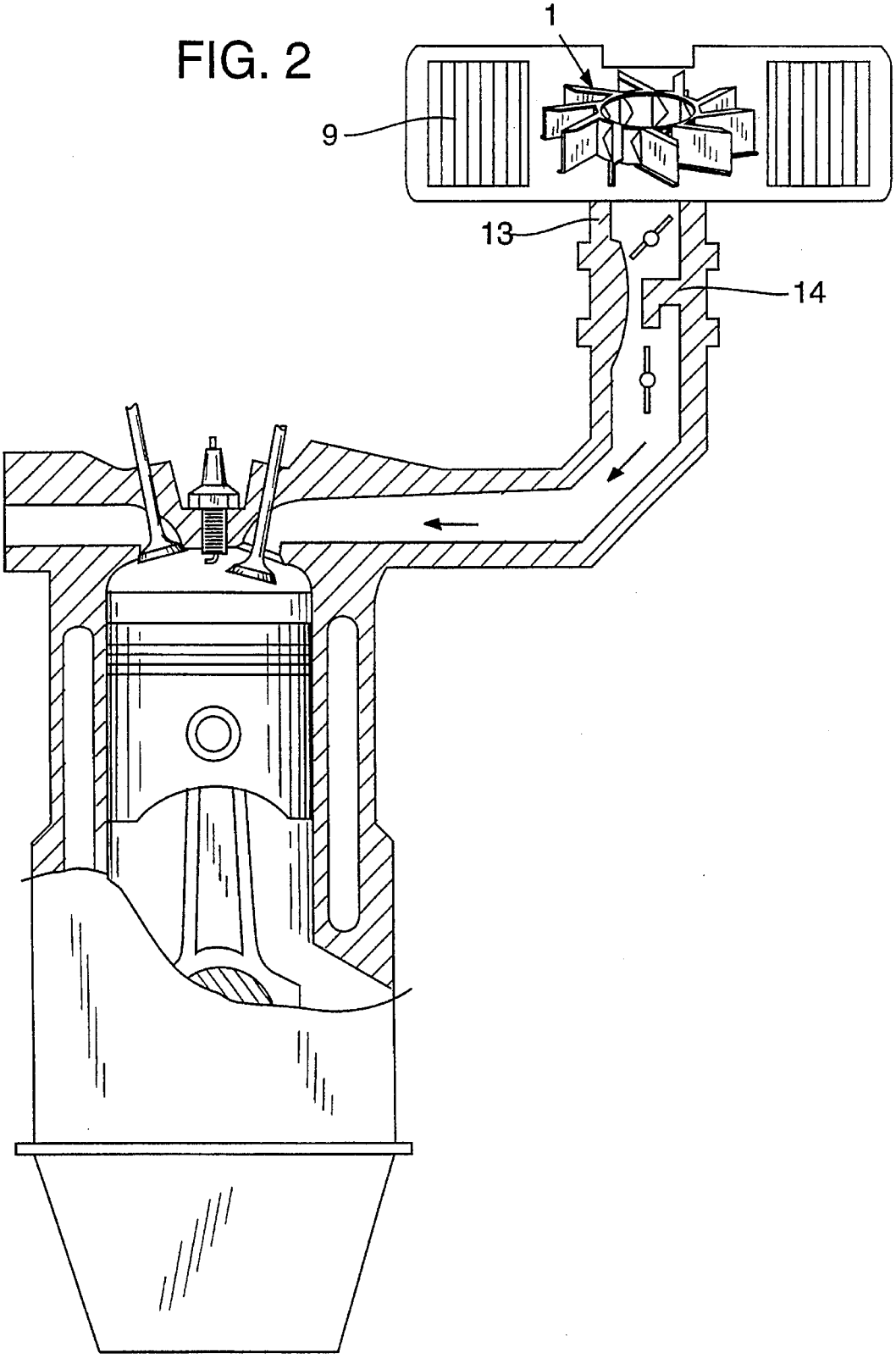
FIG. 2 is a schematic cross-sectional view of an internal combustion engine which includes an air filter incorporating an air guiding device embodying the present invention and a carburettor leading to an inlet manifold of a cylinder of the combustion engine.

As shown in FIGS. 2 and 4, in use the air guiding system 1 is installed in the central well area of a standard annular air filter 9 within the filter element. The hole 3 of the air guiding device receives an air filter closure securing bolt 10 which protrudes from the base of the air filter 9. The bolt 10 passes through the hole 3 and is used to locate an air filter closure 11 upon the air filter 9. The closure 11 is secured to the air filter 9 by means of a butterfly nut 12 or the like. Upon securing the closure 11, the air guiding system 1 is also firmly located in the air filter 9. The vanes 4 of the air guiding device 1 are positioned in the air filter 9 so as to be at a tangent to the entrance of an inlet manifold 13 leading to a carburettor 14.

Figure 3:
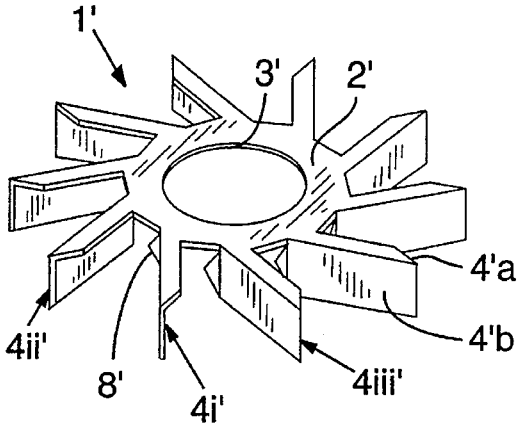
FIG. 3 is a perspective view of a second embodiment of an air guiding device according to the present invention.
Figure 5:
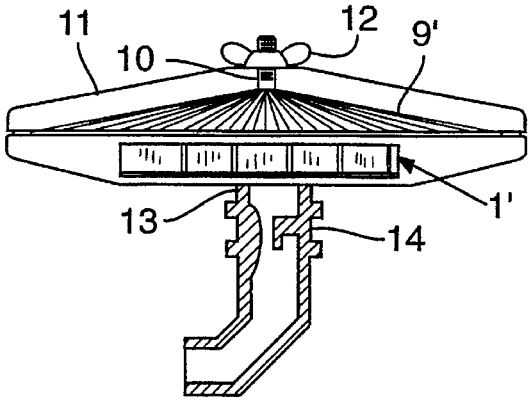
FIG. 5 shows the air guiding device of FIG. 3 located under a conical filter element of an air filter.

The air guiding device 1' shown in FIG. 3 is similar to that shown in FIG. 1 and operates in an identical fashion but is of a flatter design to enable the air guiding device 1' to fit under the filter element of an air filter 9' of a conical type as shown in FIG. 5. The air guiding device 1' of FIG. 3 is also provided with small tabs 8 on the radially innermost edge of each vane 4 and the function of these will be discussed later.

The general fan shape of the air guiding devices 1, 1' shown in FIGS. 1 and 3 means that air passing through the filters 9, 9' is travelling radially inwardly and parallel to the plane of the hub plate 2 as it enters the air guiding device. The air impinges on the vanes 4, 4' of the air guiding system 1, 1' and is deflected toward the narrow opening defined between the radially innermost edge of each vane 4, 4' and the rear face of the adjacent leading vane 4*ii*, 4*ii'* and then drawn downwardly towards the carburettor 14. However, because the air has been deflected by the vanes 4, 4', and now has a tangential velocity component as well as a downwardly oriented velocity component, a vortex is created under the hub plate 2, 2' and the swirling air flow is drawn down into the carburettor 14. Fuel droplets provided by the carburettor 14 mix more readily with the vortical air flow than would otherwise be the case if the air flow were non-vortical.

Thus, a better mixture of fuel and air is achieved and the resulting homogeneous mixture is more readily and efficiently combustible in the combustion chamber of the engine.

The operation of the air guiding devices 1, 1' shown in FIGS. 1 and 3, is significantly improved for low air flow rates by the tabs 8, 8' provided on the radially innermost edges of the vanes 4, 4'. When the air flow rate through the air filter 9, 9' is low, such as when the engine is idling, and the deflecting action of the vanes 4, 4' is not appreciable, the small tabs 8, 8' serve to deflect the air flow as it enters the narrow opening between the radially innermost edge of one vane 4*i* and the back of the adjacent leading vane 4*ii* thereby entering the space under the hub plate 2 tangentially to the circular hub plate 2. Thus, even at low flow rates, the air being drawn down towards the carburettor has a certain tangential velocity, resulting in a vortical or turbulent air flow which, as mentioned above, serves to provide better mixing of the fuel droplets with the air.

The resultant air flow which has passed through the air guiding device 1, 1' may be turbulent and/or vortical.

The tabs 8, 8' may, in an alternative embodiment of the air guiding device 1, 1' which is not shown in the drawings, be provided as projections from the hub plate 2 which projections extend downwardly adjacent the radially innermost edge of each vane 4, 4' but which are not formed as a part of each vane 4, 4' as shown in the embodiments illustrated in the drawings.

We claim:

1. An air guiding device for producing a vortical and turbulent air flow in an inlet manifold, which device comprises: a hub portion having a periphery; a plurality of vanes carried by the hub portion and extending outwardly from the periphery of the hub portion; for deflecting an air flow impinging on the device in a first direction to create a first vortical and turbulent air flow; a series of openings defined between the edges of adjacent vanes at the periphery of the hub portion, and a tab associated with at least one of the vanes located on the radially innermost edge of a vane within one of the openings at an angle to the vane for deflecting the air flow in a second direction to create a second vortical and turbulent air flow at low air flow rates at which the vanes would not create a substantial first vortical and turbulent air flow, the arrangement being such that the air flow impinging on the device is deflected into a vortical and turbulent air flow by the vanes and at least one associated tab.

2. An air guiding device according to claim 1, wherein each vane is provided with a tab.

3. An air guiding device according to claim 1, wherein the device is located in an annular air filter.

4. An air guiding device according to claim 1, wherein the device is interposed between an air filter and an inlet manifold entrance.

5. An air guiding device according to claim 1, wherein the at least one associated tab is disposed at approximately 135° to the associated vane.

6. An air guiding device according to claim 5, wherein each vane is provided with a tab.

7. An air guiding device according to claim 5, wherein the device is located in an annular air filter.

8. An air guiding device according to claim 5, wherein the device is interposed between an air filter and an inlet manifold entrance.

9. An air guiding device according to claim 1, wherein the hub portion is substantially circular and the vanes extend outwardly from the periphery of the hub at an angle of substantially 45° from the radial direction.

10. An air guiding device according to claim 9, wherein the at least one associated tab is disposed at approximately 135° to the associated vane.

11. An air guiding device according to claim 9, wherein each vane is provided with a tab.

12. An air guiding device according to claim 9, wherein the device is located in an annular air filter.

13. An air guiding device according to claim 9, wherein the device is interposed between an air filter and an inlet manifold entrance.

14. An air guiding device according to claim 1, wherein the device is located adjacent an inlet manifold entrance such that the vortical and turbulent air flow is drawn into the inlet manifold.

15. An air guiding device according to claim 14, wherein the at least one associated tab is disposed at approximately 135° to the associated vane.

16. An air guiding device according to claim 14, wherein each vane is provided with a tab.

17. An air guiding device according to claim 14, wherein the device is located in an annular air filter.

18. An air guiding device according to claim 14, wherein the device is interposed between an air filter and an inlet manifold entrance.

19. An air guiding device according to claim 14, wherein the hub portion is substantially circular and the vanes extend outwardly from the periphery of the hub at an angle of substantially 45° from the radial direction.

20. An air guiding device according to claim 19, wherein the at least one associated tab is disposed at approximately 135° to the associated vane.

* * * * *